US007250600B2

(12) United States Patent
Yamaguchi et al.

(10) Patent No.: US 7,250,600 B2
(45) Date of Patent: Jul. 31, 2007

(54) MASS SPECTROMETER WITH AN ION TRAP

(75) Inventors: Shinichi Yamaguchi, Kyouto-fu (JP); Eizo Kawato, Kyoto-fu (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 10/923,822

(22) Filed: Aug. 24, 2004

(65) Prior Publication Data

US 2005/0045816 A1 Mar. 3, 2005

(30) Foreign Application Priority Data

Aug. 26, 2003 (JP) ..... 2003-300707

(51) Int. Cl.
*H01J 49/42* (2006.01)
*H01J 49/40* (2006.01)
*H01J 49/00* (2006.01)

(52) U.S. Cl. ..... 250/292; 250/287; 250/288; 250/281; 250/282

(58) Field of Classification Search ..... 250/282, 250/281, 291, 292, 288, 287
See application file for complete search history.

(56) References Cited

U.S. PATENT DOCUMENTS 4,736,101 A * 4/1988 Syka et al. ..... 250/292
5,285,063 A * 2/1994 Schwartz et al. ..... 250/282
5,381,006 A * 1/1995 Wells et al. ..... 250/282
5,679,950 A * 10/1997 Baba et al. ..... 250/281
5,714,755 A * 2/1998 Wells et al. ..... 250/281
5,783,824 A * 7/1998 Baba et al. ..... 250/281
6,075,244 A * 6/2000 Baba et al. ..... 250/292
6,087,658 A * 7/2000 Kawato ..... 250/292

(Continued)

OTHER PUBLICATIONS

R. E. March et al.; "Quadrupole Storage Mass Spectrometry", John Wiley & Sons, pp. 31-110, 1989.

*Primary Examiner*—Nikita Wells
*Assistant Examiner*—Johnnie L Smith, II
(74) *Attorney, Agent, or Firm*—Westerman, Hattori, Daniels & Adrian, LLP.

(57) ABSTRACT

In the mass spectrometer of the present invention, the controller controls the time of changing the voltage applied to the electrode or electrodes of the ion trap from the ion trapping voltage to the ion ejecting voltage according to the polarity of the electric charge of ions to be ejected from the ion trap. Since positively charged ions and negatively charged ions move in the same direction if the phases of the RF voltage for generating the ion trapping electric field in the ion trap are reversed, the controller may reverse the phase of the RF voltage for trapping ions according to the polarity of the electric charge of ions when the ion ejecting time is fixed, irrespective of the polarity of the electric charge of ions to be ejected. Alternatively, the controller may change the ion ejecting time by half a cycle of the RF voltage depending on the polarity of the electric charge of ions when the ion trapping RF voltage is maintained the same. Owing to such a control, the ions are ejected when they are converging or are converged in the ion trap irrespective of the polarity of the electric charge of the ions. This minimizes the variation in the starting point of ions ejected from the ion trap, and reduces errors in their flight time in the subsequent TOF-MS, whereby the accuracy of the mass analysis is improved and the mass resolution is enhanced.

9 Claims, 2 Drawing Sheets

U.S. PATENT DOCUMENTS 6,124,592 A * 9/2000 Spangler ..... 250/287
6,576,893 B1 * 6/2003 Kawato et al. ..... 250/281
6,730,903 B2 * 5/2004 Kawato ..... 250/292
6,852,972 B2 * 2/2005 Baba et al. ..... 250/292
2002/0005479 A1 * 1/2002 Yoshinari et al. ..... 250/288
2003/0222211 A1 * 12/2003 Okumura et al. ..... 250/287

* cited by examiner

Fig. 3A
POSITIVE IONS
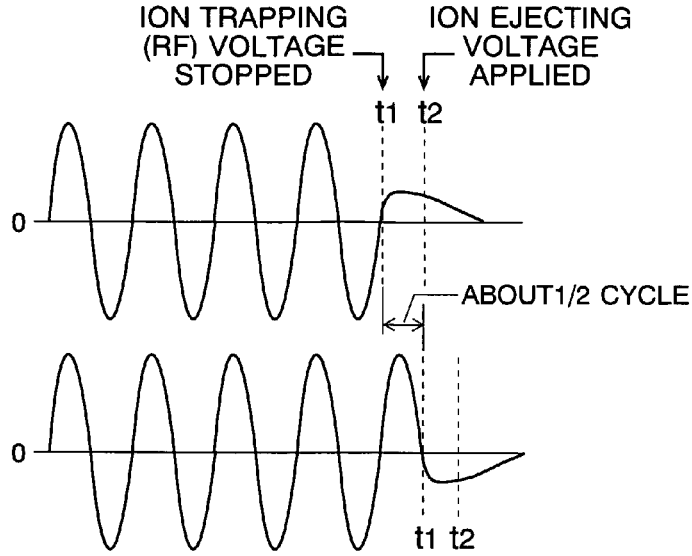
Fig. 3B
NEGATIVE IONS
Fig. 4
PRIOR ART
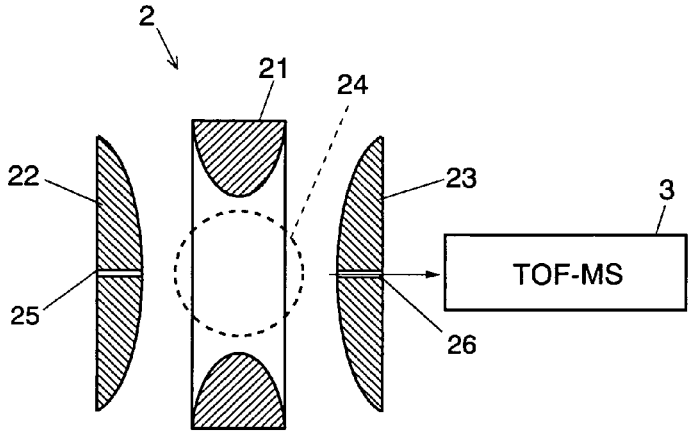

MASS SPECTROMETER WITH AN ION TRAP

The present invention relates to mass spectrometers equipped with an ion trap and a mass analyzer, where the ion trap traps and stores ions with appropriate electric fields and the mass analyzer analyzes the mass to charge ratio of ions ejected from the ion trap.

BACKGROUND OF THE INVENTION

In a time of flight mass spectrometer (TOF-MS), for example, ions are accelerated and introduced into a flight space where no electric or magnetic field is present, and they are separated by their mass to charge ratios based on the time of flight until they enter an ion detector. For the ion source of the TOF-MSs, an ion trap is often used.

A typical ion trap 2 is composed of a ring electrode 21 and a pair of end cap electrodes 22 and 23, where the ring electrode 21 is placed between them, as shown in FIG. 4. Normally, a radio frequency (RF) voltage is applied to the ring electrode 21 to form a quadrupole electric field in an ion trap space 24 defined by the ring electrode 21 and the end cap electrodes 22, 23, whereby the quadrupole electric field traps and stores ions within the ion trap 2. Ions may be generated outside of the ion trap 2 and then introduced in it, or otherwise they may be generated within the ion trap 2. Theoretical explanation of an ion trap is given in, for example, R. E. March and R. J. Hughes, "Quadrupole Storage Mass Spectrometry", John Wiley & Sons, 1989, pp. 31–110.

A wide variety of samples may be analyzed by a mass spectrometer, and the mass to charge ratio of ions to be analyzed by a mass spectrometer also varies largely. In the ion trap described above, not only the ions are stored in it, but also various other treatments are performed in it; e.g., the ion trapping potential is optimized, their vibration is cooled, ions of certain mass to charge ratio are selected, or selected ions are dissociated in order to analyze the structure of the ions.

When a mass analysis is to be done by the TOF-MS 3, the application of the RF voltage to the ring electrode 21 is stopped at the time when the object ions to be analyzed are prepared in the ion trap 2. Then a certain voltage is applied between the end cap electrodes 22 and 23 to form an ion ejecting electric field in the ion trap 2. Owing to the ion ejecting electric field, the ions are accelerated and ejected from the ion trap 2 through an ejection hole 26 of an end cap electrode 23. The ejected ions are analyzed by the TOF-MS 3.

In the mass analysis at the TOF-MS 3, the flight time until the ions are detected by the ion detector 31 of the TOF-MS 3 varies according to the starting point of the ions of the same mass to charge ratio. When the electric field for trapping ions is formed in the ion trap 2 as explained above, ions in it vibrate owing to the electric field. Since the vibration is caused by the interaction between the electric field and the electric charge of the ions, the kinetics of the ions is different in the same electric field depending on the polarity of the electric charge of the ions. Therefore the starting point of the ions when they are ejected from the ion trap 2 vary largely depending on the stopping time of the ion trapping RF voltage. This variation in the starting point causes a shift of the peaks of the mass spectrum, which makes the determination of the exact mass to charge ratio difficult and deteriorates the mass resolution of the mass spectrometer.

SUMMARY OF THE INVENTION

An object of the present invention is therefore to minimize the variation in the starting point of ions when they are ejected from an ion trap and analyzed by a mass spectrometer, irrespective of the polarity of the electric charge of the ions. This prevents a shift of the peaks of the mass spectrum, and improves the accuracy of the determination of the mass to charge ratio, and enhances the mass resolution of the mass spectrometer.

According to the present invention, a mass spectrometer includes:

an ion trap for trapping and ejecting ions;

a mass analyzer for separating the ions ejected from the ion trap by their mass to charge ratios;

a voltage source for applying a voltage to one or more electrodes of the ion trap; and a controller for controlling a time of changing the voltage from an ion trapping voltage to an ion ejecting voltage according to a polarity of the electric charge of ions to be ejected from the ion trap so that the ions are ejected when they are converging or are converged in the ion trap.

Ions trapped in an ion trap normally reciprocate between the central area ("convergence area") and the surrounding area ("dispersion area") of the ion trap. This means that, in a rough description, there are two movements of ions in the ion trap: one from the dispersion area to the convergence area; and the other from the convergence area to the dispersion area. These movements are caused by the interaction between the electric charge of ions and the electric field in the ion trap. Thus the direction of the movement of ions depends on the phase of the RF voltage applied to an electrode or electrodes of the ion trap: the direction of the movement of the positively charged ions and that of the negatively charged ions are opposite for the same RF voltage. This causes the variation in the starting point of the ions when they are ejected from the ion trap 2.

In the mass spectrometer of the present invention, the controller controls the time of changing the voltage applied to the electrode or electrodes of the ion trap from the ion trapping voltage to the ion ejecting voltage according to the polarity of the electric charge of ions to be ejected from the ion trap. Owing to such a control, the ions are ejected when they are converging or are converged in the ion trap irrespective of the polarity of the electric charge of the ions.

There are two ways of specific control. Since positively charged ions and negatively charged ions move in the same direction if the phases of the RF voltage for generating the ion trapping electric field in the ion trap are reversed, the controller may reverse the phase of the RF voltage for trapping ions according to the polarity of the electric charge of ions when the ion ejecting time is fixed irrespective of the polarity of the electric charge of ions to be ejected. Alternatively, the controller may change the ion ejecting time by half a cycle of the RF voltage depending on the polarity of the electric charge of ions when the ion trapping RF voltage is maintained the same.

Thus in the mass spectrometer of the present invention, the movements or positions of the ions at the time when they are ejected from the ion trap coincide irrespective of the polarity of the electric charge of ions, which means that ions are ejected from a narrow area within the ion trap. This minimizes the variation in the starting points of ions ejected from the ion trap, and reduces errors in their flight time in the subsequent TOF-MS, whereby the accuracy of the mass analysis is improved and the mass resolution is enhanced.

BRIEF DESCRIPTION OF THE DRAWINGS

FIGS. 3A and 3B are timing charts of the operation of the mass spectrometer of the present embodiment in the case of positively charged ions and in the case of negatively charged ions.

FIG. 4 is a schematic diagram of a TOF-MS using an ion trap.

DETAILED DESCRIPTION OF A PREFERRED EMBODIMENT

Figure 1:
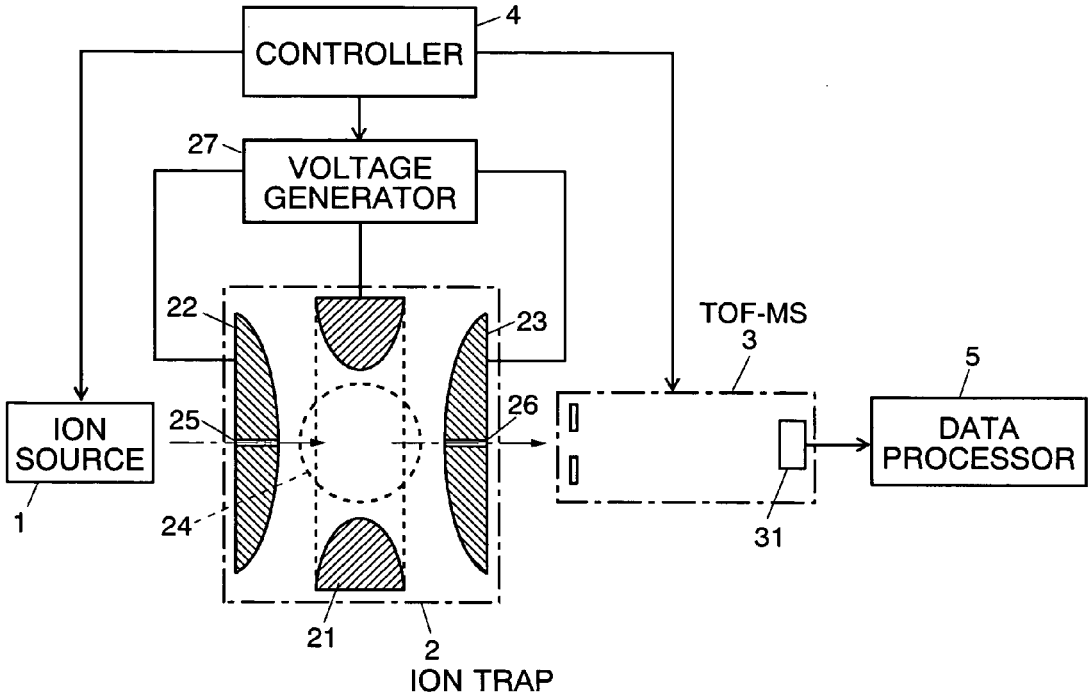
FIG. 1 is a schematic diagram of the main part of an ion trap mass spectrometer as an embodiment of the present invention.
Figure 2:
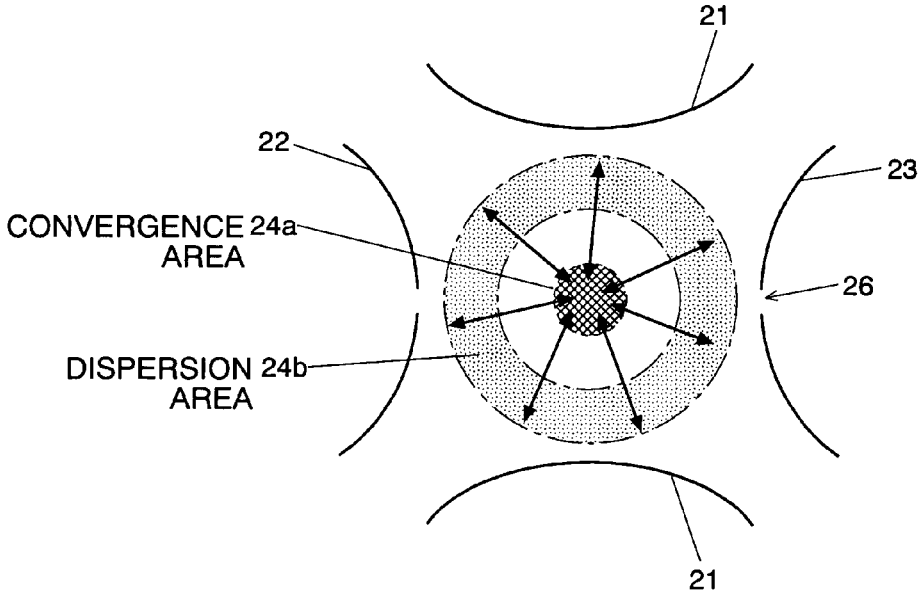
FIG. 2 is an illustration of the vibration of ions in an ion trap of the present embodiment.

A mass spectrometer using an ion trap is described as an embodiment of the present invention using FIGS. 1-3. FIG. 1 uses the same numbers for the same elements as in FIG. 4.

The ion source 1, the ion trap 2 and the TOF-MS 3 are placed in a vacuum chamber which is not shown. To the ring electrode 21, and the end cap electrodes 22, 23 are applied respective voltages from the voltage generator 27. The voltage is a DC voltage, an AC (RF) voltage or a superposition of the both voltages. The amplitude of the voltage and the time of voltage application are controlled by the controller 4 which is composed of a CPU and other electronic devices. The controller 4 controls the whole system including the ion trap 2, the ion source 1 and the TOF-MS 3.

The basic operation of the mass spectrometer of the present embodiment is as follows. The ion source 1 ionizes the molecule or atom of an object sample with an appropriate ionizing method. The ions generated in the ion source 1 are introduced into the ion trap 2 through the ion inlet hole 25 formed in an end cap electrode 22, and trapped and stored in the ion trapping space 24 in the ion trap 2. When the ions are introduced into the ion trap 2, normally, such a voltage that decreases the kinetic energy of the incoming ions is applied to the end cap electrodes 22 and 23 from the voltage generator 27. After all the ions are contained in the ion trapping space 24, they are then ejected through the ion ejecting hole 26 and introduced into the TOF-MS 3, where they are separated by their mass to charge ratios before they are detected by the detector 31. The ion detection signals from the detector 31 are sent to the data processor 5, where a predetermined data processing is performed to show a mass spectrum with the mass to charge ratio as the abscissa and the ion intensity as the ordinate. In many cases, the data processor 5 further performs a qualitative analysis and/or a quantitative analysis of the sample.

When trapping ions in the ion trap 2, normally, an RF voltage is applied to the ring electrode 21. At that time, ions in the ion trap 2 reciprocate between the narrow central area of the ion trapping space 24 (convergence area 24*a*) and the surrounding area (dispersion area 24*b*). If the ions are ejected when they are concentrated within or near the convergence area 24*a*, the starting point of the ions vary little, so that errors of the flight time in the TOF-MS 3 become smaller. If, on the other hand, the ions are ejected when they are in the dispersion area 24*b*, the starting point varies largely and errors of the flight time become large.

Such a movement of the ions in the ion trap 2 is determined by the interaction between the quadrupole electric field in the ion trapping space 24 and the electric charge of the ions, and the movements of an ion in the same quadrupole electric field are opposite each other in the case of a positively charged ion and in the case of a negatively charged ion. For example, when a positively charged ion moves from the dispersion area 24*b* to the convergence area 24*a*, a negatively charged ion moves from the convergence area 24*a* to the dispersion area 24*b*. The controller 4 controls the voltage generator 27 so that ions are always ejected from the ion trap 2 when they are within or near the convergence area 24*a* irrespective of the polarity of the electric charge of the ions.

The RF component of the voltage applied to the ring electrode 21 from the voltage generator 27 when trapping ions in the ion trap 2 is an AC voltage of a constant frequency as shown in FIG. 3. When ions are ejected, first, the RF component is stopped at the time point t1, and at the time point t2, which is a preset time period after the time point t1, an ion ejecting voltage is applied between the end cap electrodes 22 and 23. It is possible to apply the ion ejecting voltage just after the RF component voltage is stopped, but it takes a certain period from the time when the RF component is stopped to the time when the actual voltage applied to the ring electrode 21 subsides to zero due to various electric components such as a coil used around the voltage applying circuit. The time interval $t_2-t_1$ is determined regarding the subsiding period. Since there is no ion trapping effect, and ions may move freely and disperse during the subsiding period, taking a large time interval $t_2-t_1$ is not recommended.

When the electric field is turned from the ion trapping field to the ion ejecting field as described above, the direction of movement and the position of ions at the time when they are ejected depend primarily on the stopping time of the RF voltage. Thus the controller 4 shifts the RF stopping time by half a cycle according to the polarity of the electric charge of ions to be ejected from the ion trap 2. In the case of positively charged ions, the RF voltage is stopped when the voltage wave cross the zero line from negative to positive, as in FIG. 3A, while in the case of negatively charged ions, the RF voltage is stopped half a cycle later when the voltage wave cross the zero line from positive to negative, as in FIG. 3B. Owing to such a control, ions converge within or near the convergence area 24*a* when they are ejected from the ion trap 2 irrespective of the polarity of the electric charge of the ions. This minimizes the variation in the starting point of the ions of the same mass to charge ratio, and decreases errors in their flight time until they are detected by the detector 31 in the TOF-MS 3.

In the above explanation, the stopping time of the RF voltage is shifted by half a cycle under the condition that the ion trapping RF voltages for the positively charged ions and for the negatively charged ions are adjusted to come into the same phase. It can be viewed differently if the RF voltage stopping time is adjusted to coincide: in this case, the phases of the ion trapping RF voltages for the positively charged ions and for the negatively charged ions are adjusted to be opposite to each other.

The above-described embodiment is only an example, and it is obvious for those skilled in the art to modify it or add unsubstantial elements to it within the scope of the present invention.

What is claimed is:

1. A mass spectrometer comprising:

an ion trap for trapping and ejecting ions;

a mass analyzer for separating the ions ejected from the ion trap by their mass to charge ratios;

a voltage source for applying a voltage to one or more electrodes of the ion trap; and a controller for controlling a time of switching the voltage from an ion trapping voltage to an ion ejecting voltage according to a polarity of the electric charge of ions to be ejected from the ion trap so that switching is made when they are converging or are converged in a central area of the ion trap.

2. The mass spectrometer according to claim 1, wherein the controller shifts the time of switching the voltage by half a cycle of an RF voltage of the ion trapping voltage between the case when ions to be ejected are positively charged ions and the case when ions to be ejected are negatively charged ions.

3. The mass spectrometer according to claim 1, wherein the controller adjusts phases of an ion trapping RF voltages for positively charged ions and for the negatively charged ions to be opposite to each other, and adjusts the switching time to be the same in the case when ions to be ejected are positively charged ions and in the case when ions to be ejected are negatively charged ions.

4. An ion trap for trapping and ejecting ions for a mass spectrometer comprising:

a voltage source for applying a voltage to one or more electrodes of the ion trap; and a controller for controlling a time of switching the voltage from an ion trapping voltage to an ion ejecting voltage according to a polarity of the electric charge of ions to be ejected from the ion trap so that switching is made when they are converging or are converged in a central area of the ion trap.

5. The ion trap according to claim 4, wherein the controller shifts the time of switching by half a cycle of an RF voltage of the ion trapping voltage between the case when ions to be ejected are positively charged ions and the case when ions to be ejected are negatively charged ions.

6. The ion trap according to claim 4, wherein the controller adjusts phases of an ion trapping RF voltages for positively charged ions and for the negatively charged ions to become opposite to each other, and adjusts the time of switching to be the same in the case when ions to be ejected are positively charged ions and in the case when ions to be ejected are negatively charged ions.

7. A method of controlling an ion ejecting time of an ion trap for trapping and ejecting ions for a mass spectrometer wherein ions are ejected according to a polarity of the electric charge of ions to be ejected from the ion trap by switching the ion trapping voltage to the ion ejecting voltage when they are converging or are converged in a central area of the ion trap.

8. The ion ejecting time controlling method according to claim 7, wherein the ion ejecting time is shifted by half a cycle of an RF voltage of the ion trapping voltage between the case when ions to be ejected are positively charged ions and the case when ions to be ejected are negatively charged ions.

9. The ion ejecting time controlling method according to claim 7, wherein phases of an ion trapping RF voltages for positively charged ions and for the negatively charged ions are adjusted to be opposite to each other and the switching is adjusted to be the same in the case when ions to be ejected are positively charged ions and in the case when ions to be ejected are negatively charged ions.

* * * * *